US006375285B1

(12) United States Patent
Choi

(10) Patent No.: US 6,375,285 B1
(45) Date of Patent: Apr. 23, 2002

(54) MULTIPLE ASSEMBLY

(76) Inventor: Deok-Hwan Choi, Keonyoung Apt. 102-1705, 108, Chungdam-dong, Kangnam-ku, Seoul (KR)

( * ) Notice: Subject to any disclaimer, the term of this patent is extended or adjusted under 35 U.S.C. 154(b) by 0 days.

(21) Appl. No.: 09/524,300

(22) Filed: Mar. 14, 2000

(30) Foreign Application Priority Data

Sep. 2, 1999 (KR) ..... 1999-18044
Jan. 14, 2000 (KR) ..... 2000-977

(51) Int. Cl.[7] ..... A47B 53/00

(52) U.S. Cl. ..... 312/202; 312/107; 16/235; 16/221; 211/183

(58) Field of Search ..... 312/202, 298; 108/64, 103; 160/135; 211/182, 183; 16/235, 221

(56) References Cited

U.S. PATENT DOCUMENTS 241,123 A * 5/1881 Danner ..... 312/202 X
3,002,787 A * 10/1961 Ziegenfuss ..... 108/64 X
5,842,425 A * 12/1998 van der Aa ..... 108/103 X

* cited by examiner

*Primary Examiner*—Peter M. Cuomo
*Assistant Examiner*—Michael J. Fisher
(74) *Attorney, Agent, or Firm*—Nixon Peabody LLP

(57) ABSTRACT

A multiple assembly includes two or more unit products spaced apart from each other with a predetermined shape. One or more connection members are provided to interconnect the neighboring unit products such that the unit products can be folded and unfolded. The unit products can rotate around connection points to exert intrinsic functions in at least one direction.

9 Claims, 8 Drawing Sheets

MULTIPLE ASSEMBLY

BACKGROUND OF THE INVENTION (a) Field of the Invention

The present invention relates to a multiple assembly and, more particularly, to a multiple assembly which can be freely folded or unfolded with a plurality of products, and exert the functions of the products in various manners while giving the user great convenience in storage and carriage.

(b) Description of the Related Art

Generally, electric heaters, tents, audio, lights, and other products (hereinafter referenced as the "unit product") have their own shapes and functions, and are independently used for particular purposes.

When such unit products are individually used, their functions should be limited. For instance, the electric heater generates heat in a particular direction, and the projection of the light is also limited in direction. Therefore, several numbers of unit products should be separately prepared in place to perform the desired works.

However, when such unit products are used in a separate manner, it becomes difficult for the user to centralize or decentralize the functions of the unit products or to store and carry them.

Furthermore, when the unit products are simply combined with one another to solve the above problems, it becomes difficult to control the distance between the neighboring unit products in an arbitrary manner so that the functions of the unit products cannot be exerted in an appropriate manner.

In addition, when portable unit products such as a burner are used under a strong wind or a dense air, or when large amounts of foods should be cooked, several numbers of unit products should be used for the cooking. In this case, it becomes difficult to carry such burners, and to centralize or decentralize the heating power of the burners.

SUMMARY OF THE INVENTION

It is an object of the present invention to provide a multiple assembly which can be freely folded or unfolded to thereby centralize or decentralize the functions of the unit products, and give the user convenience in storage and use.

It is another object of the present invention to provide a multiple assembly which can be easily carried with, and control the distance between the neighboring unit products to thereby effectively exert the functions of the unit products.

These and other objects may be achieved by a multiple assembly including two or more unit products spaced apart from each other with a predetermined shape. One or more connection members are provided to interconnect the neighboring unit products such that the unit products can be folded and unfolded. The unit products can rotate around connection points to exert intrinsic functions in at least one direction.

Each connection member includes a connector fixed to at least one side of each unit product, and a connecting shaft interconnecting the neighboring connectors such that the connectors can rotate around the connecting shaft.

Alternatively, each connection member may include one or more insertion holes formed at one side of each unit product, a connector movably inserted into each insertion hole, and a connecting shaft interconnecting the neighboring connectors such that the connectors can rotate around the connecting shaft.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1:
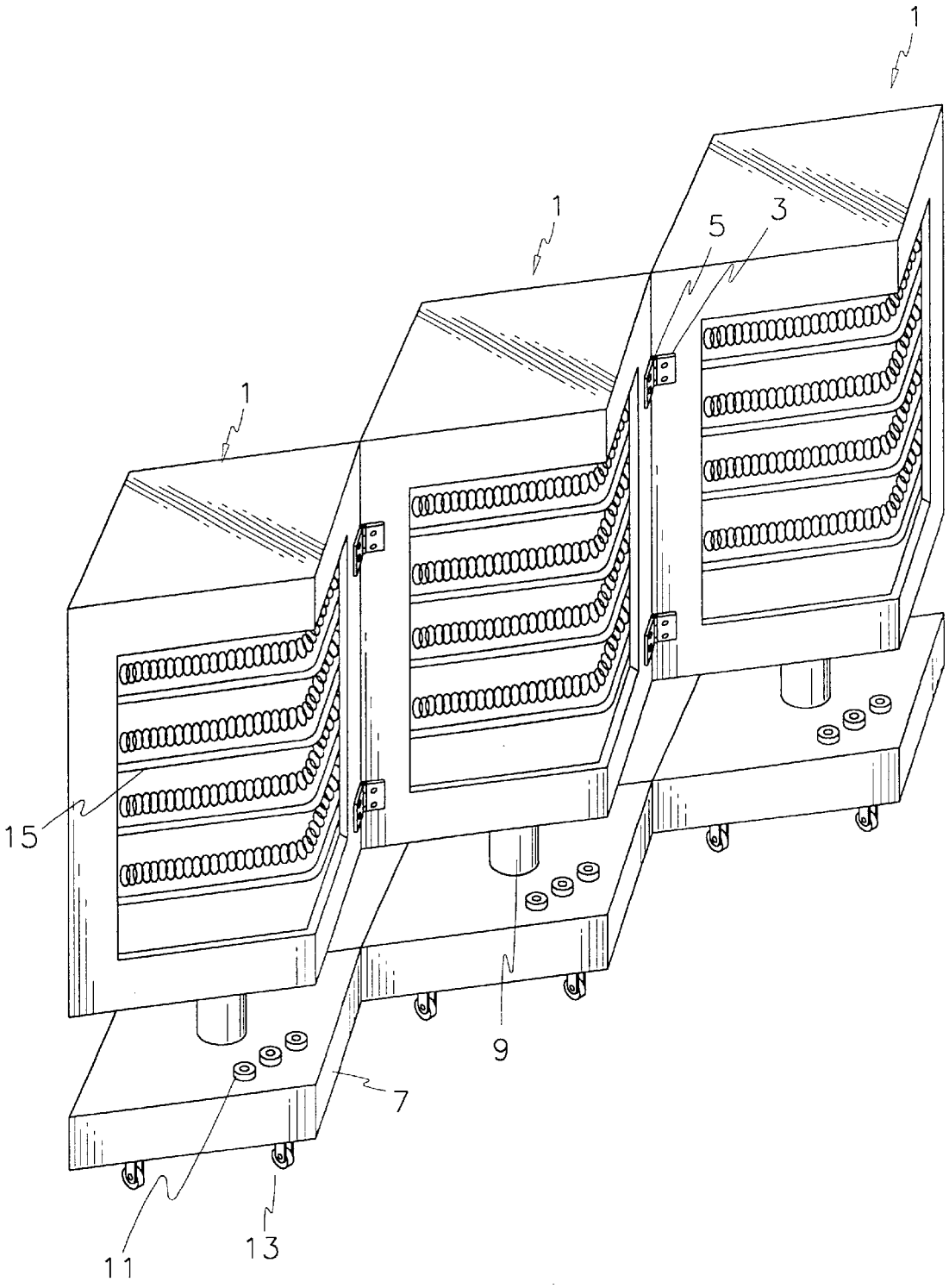
FIG. 1 is a perspective view of a multiple assembly according to a first preferred embodiment of the present invention.
Figure 2:
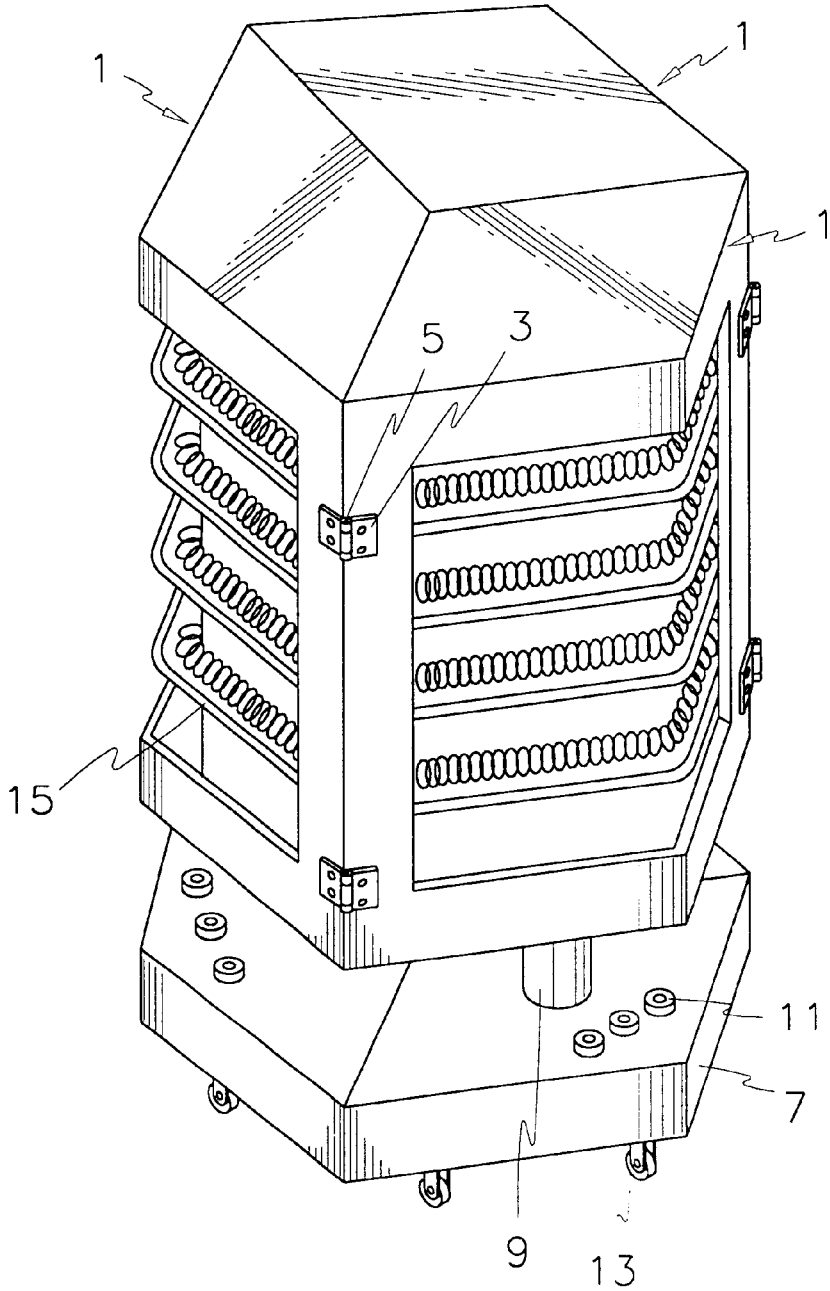
FIG. 2 is a perspective view of the multiple assembly shown in FIG. 1 at its another state.

FIG. 1 is a perspective view of a multiple assembly according to a preferred embodiment of the present invention, and FIG. 2 is a perspective view of the multiple assembly shown in FIG. 1 at its another state.

As shown in FIGS. 1 and 2, the multiple assembly includes two or more unit products 1 spaced apart from each other with a predetermined distance. Each unit product 1 is formed with a predetermined shape such that it can exert its own function in at least one direction. In this preferred embodiment, an electric heater is used for the unit product 1.

Alternatively, the unit product 1 may be a display booth, an advertising tower, an audio, a furniture, a light, a flowerpot, a household electronic, an electric fan, an interior article, a flash, a fish globe, a waste separation box, an urn, or other kinds of containers. Any products that can centralize or decentralize their functions may be applied for the unit products 1.

Furthermore, the unit products 1 may be one sort of products or two or more sorts of products.

Each unit product 1 may be formed with a shape of a polyhedron or a curved figure such that the top side of the folded unit products are shaped with a polyhedron or a curved figure such as a hexahedron.

One or more connection members are provided between the neighboring unit products 1, and interconnect the unit products 1 such that they can be folded or unfolded. Each connection member is structured such that it can be separated from the unit products 1 and control the distance between the neighboring unit products 1.

The connection member includes connectors 3 fixed to at least one side of each unit product 1, and a connecting shaft 5 interconnecting the neighboring connectors 3 such that they can be rotated. The neighboring unit products 1 are connected to each other via the connectors 3 such that they can be rotated around the connecting shaft 5.

A base 7 is provided at each unit product 1 to support it, and a height control member 9 is interposed between the base 7 and the unit product 1. A function control member 11 is installed at the base 7.

Wheels 13 are provided at the bottom side of the base 7 to carry the unit product 1 in a convenient manner, and spaced apart from each other with a predetermined distance. A safety cover 15 is provided at the frontal portion of the unit product 1.

The way of using such a multiple assembly will be now described in detail.

In case the multiple assembly is not used, the unit products 1 are completely folded toward one another via the connectors 3 and the connecting shaft 5 such that the rear portions of the unit products 1 are exposed to the outside.

When it is intended that the heating is made only in one direction, as shown in FIG. 1, the unit products 1 are rotated around the connecting shaft 5 such that they are unfolded in a serial manner.

In contrast, when it is intended that the heating is centralized at a predetermined place, the unit products 1 are rotated around the connecting shaft 5 such that they surround the desired heating place.

Furthermore, when it is intended that the heating is decentralized in various directions, as shown in FIG. 2, the unit products 1 are completely unfolded such that the frontal portions of the unit products 1 are exposed to the outside.

In the following preferred embodiments of the present invention, other components and structures of the multiple assembly are the same as those related to the first preferred embodiment except that some of the components have different structures or small numbers of components are newly introduced.

Figure 3:
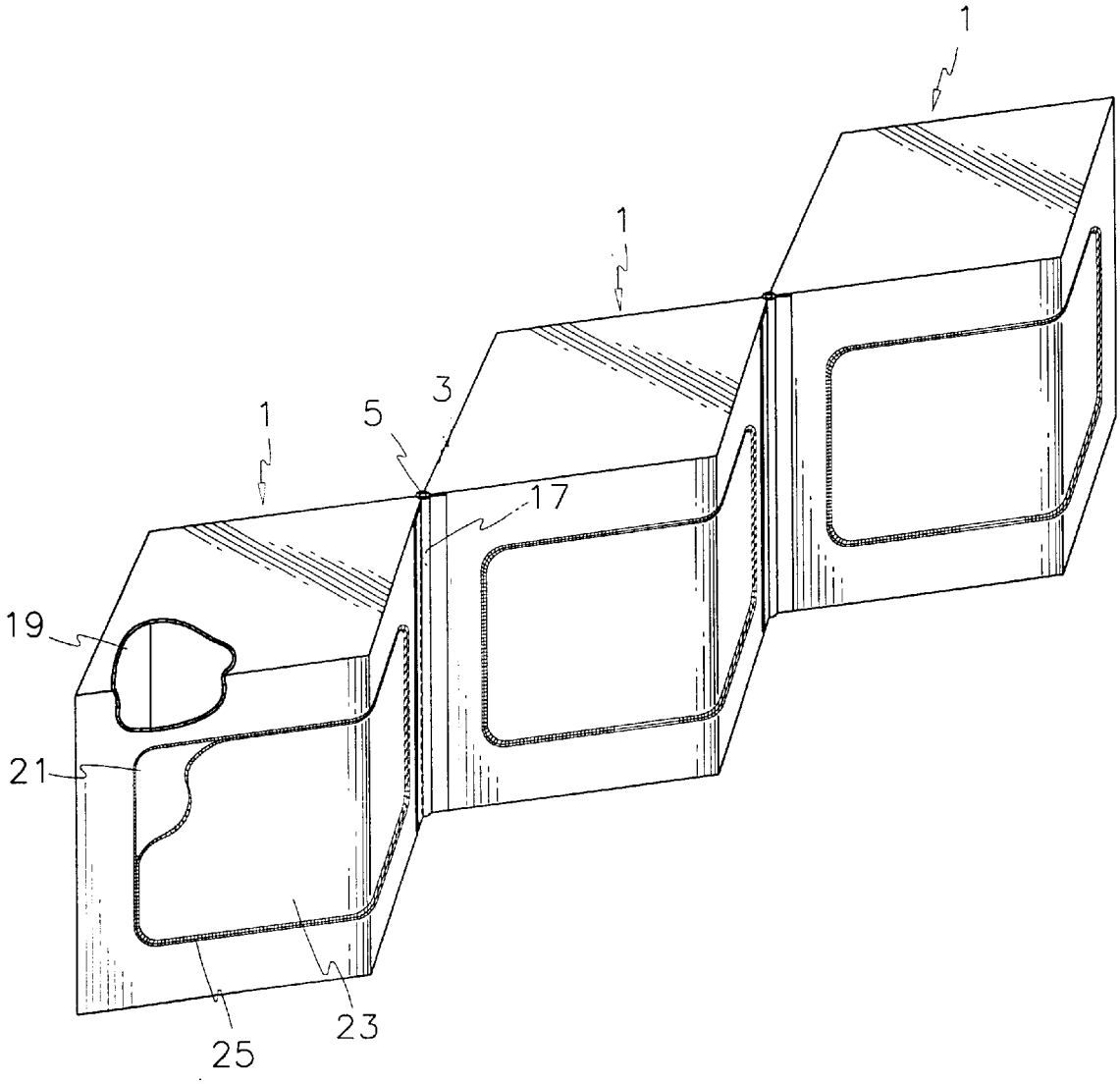
FIG. 3 is a partially sectional perspective view of a multiple assembly according to a second preferred embodiment of the present invention.
Figure 4:
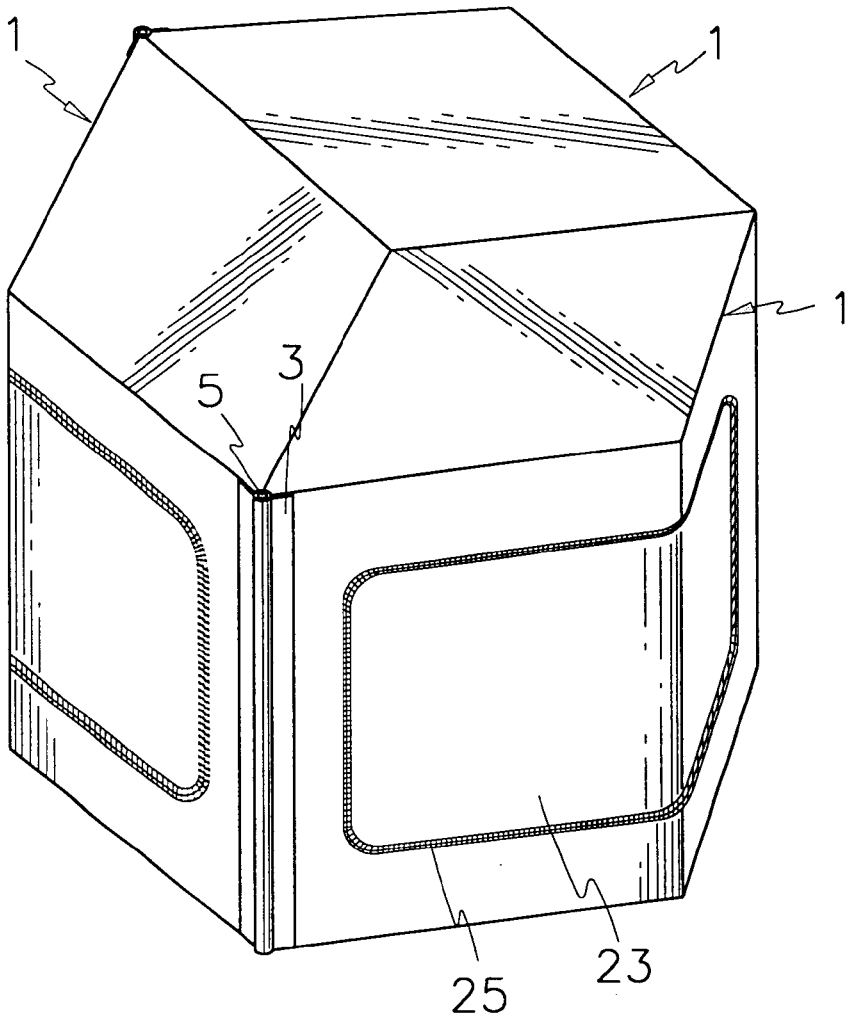
FIG. 4 is a perspective view of the multiple assembly shown in FIG. 3 at its another state.

FIGS. 3 and 4 are perspective views of a multiple assembly according to a second preferred embodiment of the present invention. In this preferred embodiment, a tent is applied for the unit product 1.

The connector 3 is connected to one side of the unit product 1 in a body while forming a hinge opening portion 17 for receiving the connecting shaft 5. The neighboring connectors 3 are also connected to each other in a body.

The unit product 1 is provided with an inner empty space 19 where persons or articles are placed. An opening portion 21 communicating with the empty space 19 is formed at one side of the unit product 1 to exhibit the contents placed at the empty space 19.

An opening and closing member 23 is provided at the frontal portion of the unit product 1 to open and close the empty space 19 via a zipper.

According to the positional conditions of the multiple assembly or the needs of the user, the unit products 1 can be rotated around the connecting shaft 5 to form the desired shape. For example, as shown in FIG. 3, the unit products 1 are unfolded such that they are arranged in a serial manner.

Furthermore, the unit products 1 may be completely unfolded, and close to one another such that the opening and closing members 23 are exposed to the outside.

Alternatively, the opening and closing member 23 may be absent, and the persons or articles placed at the empty space 19 can be directly shown from the outside.

Figure 5:
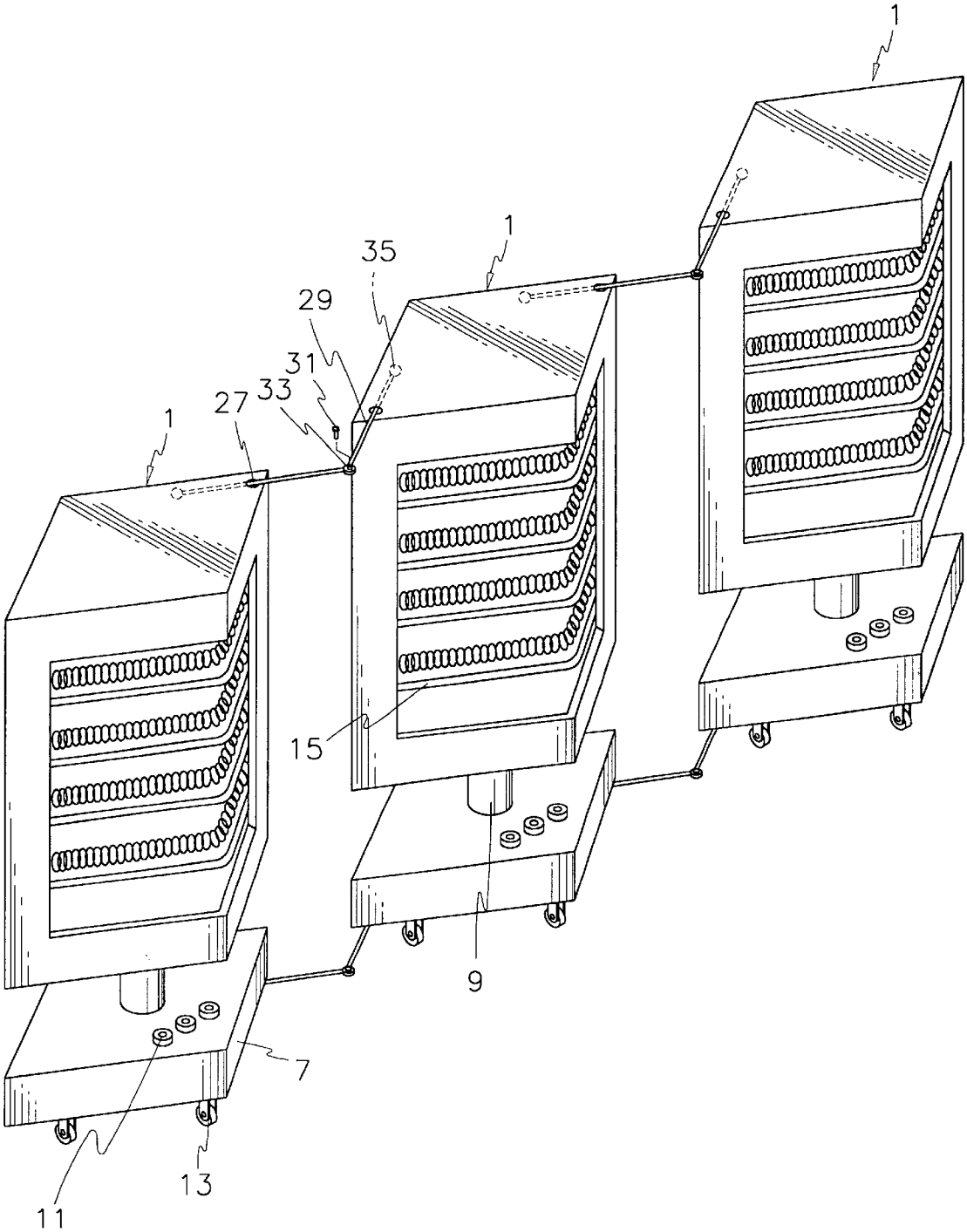
FIG. 5 is a perspective view of a multiple assembly according to a third preferred embodiment of the present invention.
Figure 6:
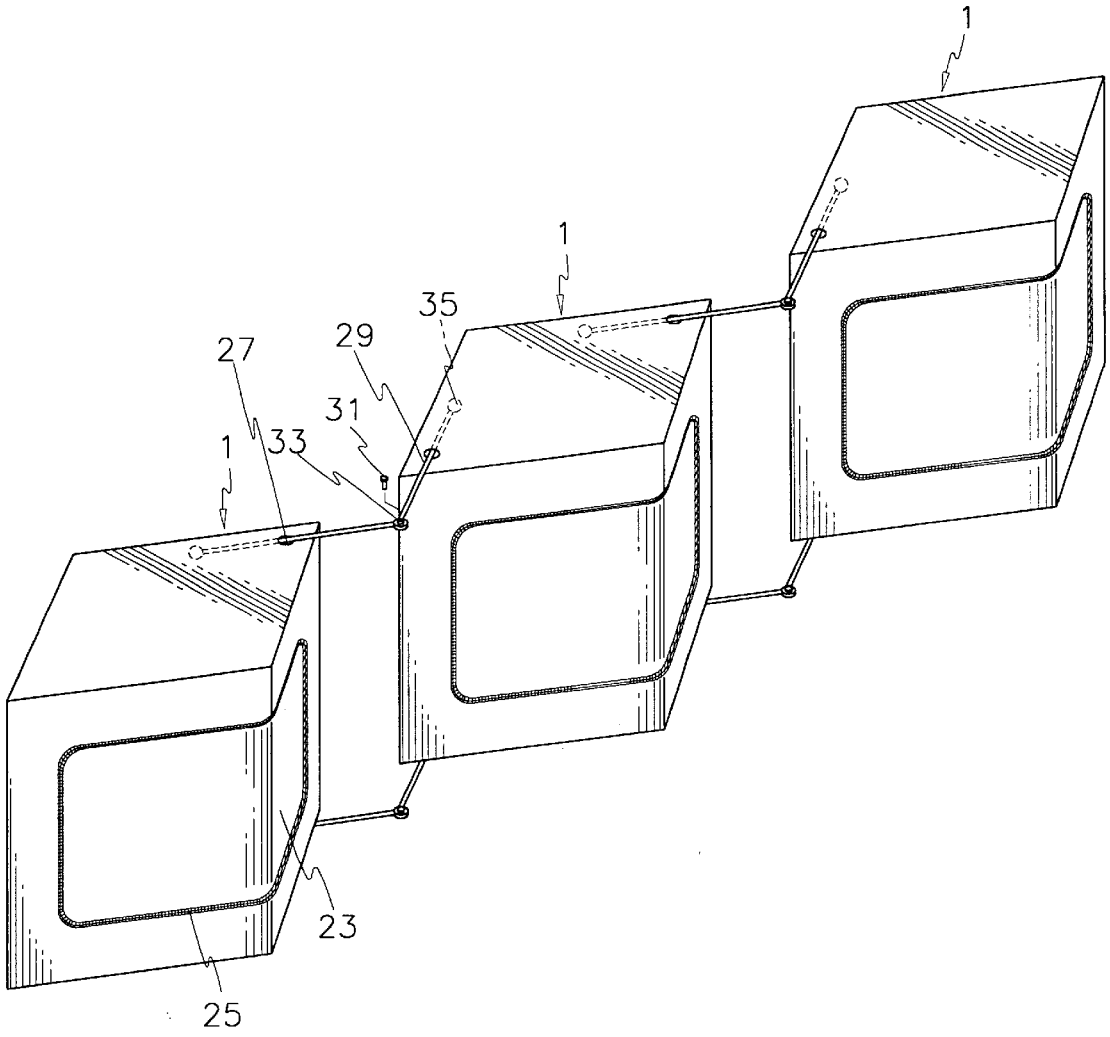
FIG. 6 is a perspective view of a multiple assembly according to a fourth preferred embodiment of the present invention.

FIG. 5 is a perspective view of a multiple assembly according to a third preferred embodiment of the present invention, and FIG. 6 is a perspective view of a multiple assembly according to a fourth preferred embodiment. In these preferred embodiments, other components of the multiple assemblies are the same except that an electric heater is applied for the unit product 1 in the third preferred embodiment, whereas a tent for the unit product 1 in the fourth preferred embodiment.

The connection member includes one or more insertion holes 27 formed at one side of the unit product 1, a connector 29 movably inserted into the insertion hole 27, and a connecting shaft 31 interconnecting the neighboring connectors 29 such that they can be rotated.

The connector 29 is preferably cylindrical-shaped with a predetermined length such that it can freely move within the insertion hole 27. It is preferable that the connector 29 has suitable flexibility and rigidity.

One or more combination holes for receiving the connecting shaft 31 are formed at an end of the connector 29 with a predetermined size.

A protrusion 35 is formed at an opposite end of the connector 29 to prevent escape of the connector 29 from the insertion hole 27 of the unit product 1.

Figure 7:
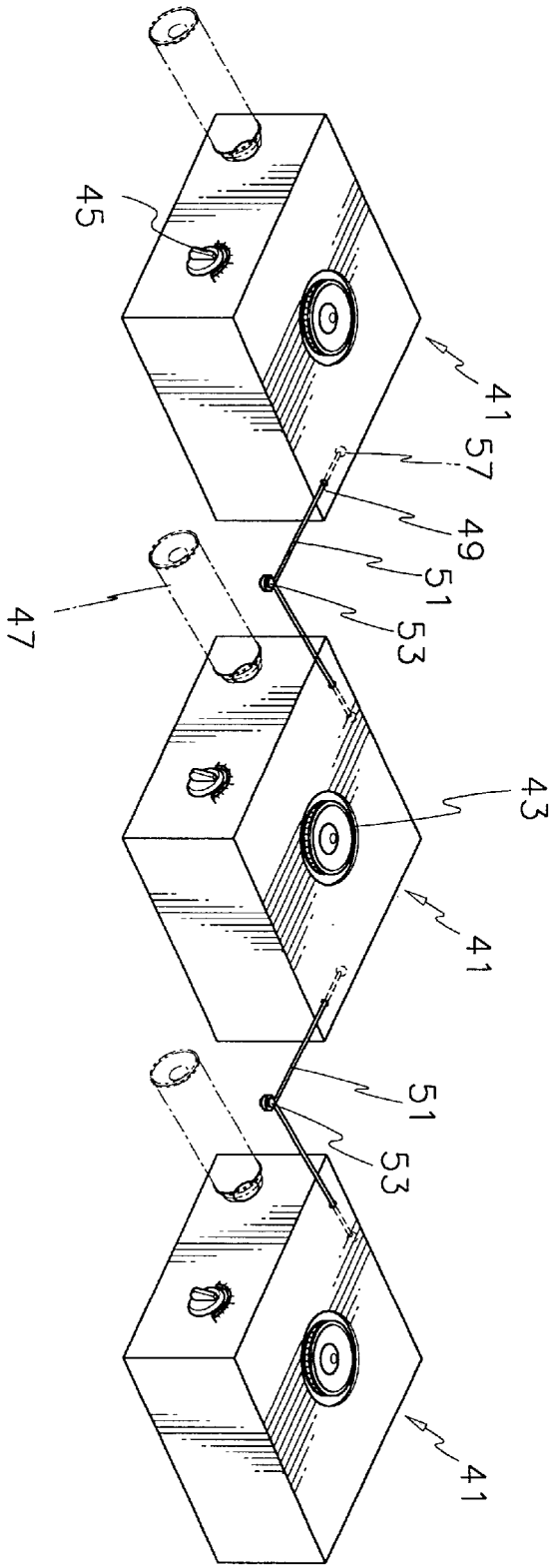
FIG. 7 is a perspective view of a multiple assembly according to a fifth preferred embodiment of the present invention.
Figure 8:
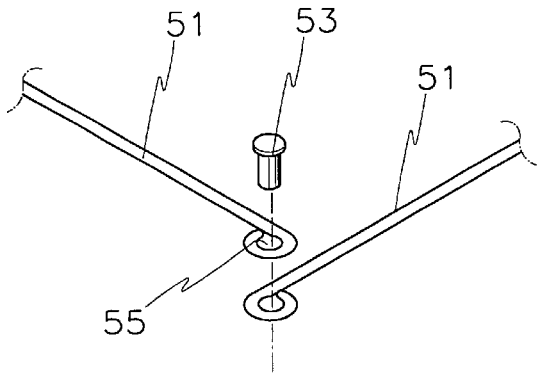
FIG. 8 is a partially amplified view of the multiple assembly shown FIG. 7.
Figure 9:
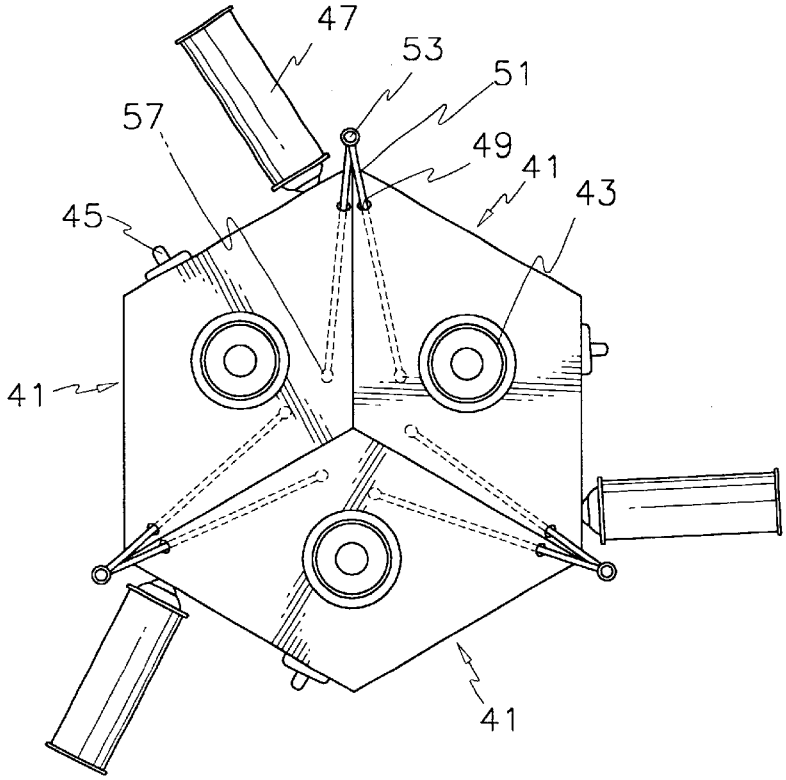
FIG. 9 is a plan view of the multiple assembly shown in FIG. 7 at its another state.

FIGS. 7 to 9 are views of a multiple assembly according to a fifth preferred embodiment of the present invention where a burner is applied for the unit product 41.

As shown in the drawings, the multiple assembly includes two or more unit products 41 spaced apart from each other with a predetermined distance, and connection members interconnecting the neighboring unit products 41 such that they can be folded or unfolded. Each unit product 41 is provided with a burner head 43 for generating flame. A control lever 45 is installed at one side of the unit product 41 to control the ignition or force of the fire, and a fuel tank 47 is connected to the unit product 41 to feed fuel thereto.

The connection member includes one or more insertion hole 49 formed at one side of the unit product 41, a connector 51 movably inserted into the insertion hole 49, and a connecting shaft 53 interconnecting the neighboring connectors 51 such that they can be rotated around the connecting shaft 53.

The connector 51 is preferably cylindrical-shaped with a predetermined length such that it can freely move within the insertion hole 49 of the unit product 41. Furthermore, it is preferable that it should have suitable degree of flexibility and rigidity.

Two or more combination holes 55 for receiving the connecting shaft 53 are formed at an end of the connector 51 with a predetermined size.

A protrusion 57 is formed at an opposite end of the connector 51 to prevent escape of the connector 51 from the insertion hole 49 of the unit product 41.

As the unit products 41 are connected to each other via the connectors 51 such that they can be rotated around the connecting shaft 53, the carrying of the multiple assembly can be easily performed.

When it is intended that plural numbers of cooking articles are heated by using the multiple assembly, the unit products 41 are first rotated around the connecting shaft 53 such that they are unfolded in a serial manner. Then, the connector 51 moves within the insertion hole 49 toward the outside of the unit product 41 so that the distance between the neighboring unit products is widened. The distance between the neighboring unit products 41 is preferably controlled such that the cooking articles placed at the unit products 41 do not contact each other.

At this state, the cooking articles are put on the burner heads 43 of the unit products 41, and the control lever 45 is operated such that flame is generated from the burner heads 43 to heat the cooking articles.

Furthermore, when it is intended that large amounts of foods should be cooked under the conditions of a strong wind or a dense air by using such a multiple assembly, the connector 51 is completely inserted into the unit products 41 along the insertion hole 49 such that the unit products 41 are close to one another. The unit products 41 are rotated around the connecting shaft 53 such that the top of the unit products 41 form a polygonal shape such as a hexagon as shown in FIG. 9, and the overall heating power of the burner heads 43 is centralized at one place. In this state, a cooking article is put on the burner heads 43, and the control levers 45 of the unit products 41 are operated so that flame is generated from the burner heads 43 to heat the cooking article.

In addition, when the connector 51 is completely separated from the unit product 41 through the insertion hole 49, the unit products 41 can be separately working for individual use.

As described above, the inventive multiple assembly, the unit products can be freely folded or unfolded to thereby centralize or decentralize their functions. This structure gives the user great convenience in storage and use. Furthermore, the multiple assembly can be easily carried with, and control the distance between the neighboring unit products to thereby effectively exert the functions of the unit products.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A multiple assembly comprising:

two or more unit products;

one or more connection members interconnecting the neighboring unit products around one or more connection points, each of the unit products rotatable around the connection points with respect to the other neighboring unit product;

one or more insertion passages in each of the unit products, wherein each of the connection members comprises connecting bars and a connecting shaft, one end of each of the connecting bars is secured within and slidably movable along one of the insertion passages to adjust a distance between the unit products and the connecting shaft interconnects the neighboring connecting bars such that the connecting bars can rotate around the connecting shaft.

2. The multiple assembly of claim 1 wherein the unit product comprises an electric heater, a tent, a display booth, a dressing booth, an advertising tower, furniture, a light, a flowerpot, household electronics, an electric fan, a fish globe, a waste receptacle, or an urn.

3. The multiple assembly of claim 1 wherein each connection member comprises a connector fixed to at least one side of each unit product, and a connecting shaft interconnecting the neighboring connectors such that the connectors can rotate around the connecting shaft.

4. The multiple assembly of claim 3 wherein each of the connectors has a portion with a hinge opening for receiving the connecting shaft.

5. The multiple assembly of claim 1 further comprising a protrusion at the one end of each of the connecting bars, the protrusion preventing the escape of the one end of the connecting bar from the insertion passage.

6. The multiple assembly of claim 1 wherein each unit product is provided with an inner empty space for accommodating persons or articles, and an opening in the unit product that communicates with the empty space such that the persons or articles can be shown to the outside.

7. The multiple assembly of claim 6 wherein each unit product is provided with a member for covering and exposing the opening in the unit product to the empty space.

8. The multiple assembly of claim 1 further comprising one or more wheels connected to one or more of the unit products.

9. The multiple assembly of claim 1 wherein the connection member comprises a hinge.

* * * * *